US006811006B1

(12) United States Patent
Mundle

(10) Patent No.: US 6,811,006 B1
(45) Date of Patent: Nov. 2, 2004

(54) CONVERTIBLE BRIEFCASE/TABLE

(76) Inventor: Adrian O. Mundle, 14728 Shiloh Ct., Laurel, MD (US) 20708

( * ) Notice: Subject to any disclaimer, the term of this patent is extended or adjusted under 35 U.S.C. 154(b) by 22 days.

(21) Appl. No.: 10/330,759

(22) Filed: Dec. 30, 2002

(51) Int. Cl.[7] ..... A45C 9/00

(52) U.S. Cl. ..... 190/11; 190/1; 190/18 R; 190/900

(58) Field of Search ..... 190/1, 11, 12 A, 190/18 R, 110; 206/320; 312/244, 902, 144

(56) References Cited

U.S. PATENT DOCUMENTS

| | | | | | |
|---|---|---|---|---|---|
| 260,051 | A | * | 6/1882 | Rigby | 190/10 |
| 1,292,468 | A | * | 1/1919 | Hominuke | 190/11 |
| 2,277,435 | A | * | 3/1942 | Howe | 108/35 |
| 2,808,680 | A | * | 10/1957 | Bereth | 190/11 |
| 2,905,513 | A | * | 9/1959 | Kane | 108/128 |
| 3,000,683 | A | * | 9/1961 | MacNeary | 312/235.3 |
| 3,073,057 | A | * | 1/1963 | Farber | 248/461 |
| 3,177,991 | A | * | 4/1965 | Walker | 190/11 |
| 3,263,779 | A | * | 8/1966 | Bialer | 190/110 |
| 3,306,405 | A | * | 2/1967 | Rosenblum | 190/110 |
| 3,347,346 | A | * | 10/1967 | Young | 190/110 |
| 3,512,620 | A | * | 5/1970 | Bell et al. | 190/11 |
| 4,034,518 | A | * | 7/1977 | Trecker | 5/114 |
| 4,049,091 | A | * | 9/1977 | Chubb | 190/18 R |
| 4,106,597 | A | * | 8/1978 | Shook et al. | 190/110 |
| 4,244,632 | A | | 1/1981 | Molinari | |
| 4,258,833 | A | * | 3/1981 | Simms | 190/11 |
| 4,385,619 | A | * | 5/1983 | Casinelli | 126/9 B |
| 4,790,416 | A | | 12/1988 | Baker | |
| 4,856,627 | A | | 8/1989 | Polatov | |
| 4,934,549 | A | * | 6/1990 | Allen | 220/4.24 |
| 5,242,218 | A | | 9/1993 | Cota et al. | |
| D394,954 | S | | 6/1998 | Ward | |
| 6,068,355 | A | | 5/2000 | Thorp | |
| 6,371,288 | B1 | * | 4/2002 | Licata | 206/214 |
| 6,530,475 | B1 | * | 3/2003 | Penney | 206/320 |
| 2002/0063072 | A1 | * | 5/2002 | Pham | |

* cited by examiner

*Primary Examiner*—Sue A. Weaver

(57) ABSTRACT

A convertible briefcase/table for providing a user carrying a briefcase with a convenient work table where none may be readily available. The convertible briefcase/table includes a case assembly having a base member, and also having a cover member being hingedly attached to the base member; and also includes a tabletop being hingedly attached to the case assembly; and further includes a tabletop support assembly including brackets being attached to the tabletop and also including support legs being hingedly attached to the brackets; and also includes a fastening assembly for fastening the tabletop to the cover member; and further includes a case support assembly being attached to the case assembly for standing the case assembly upon a surface.

3 Claims, 4 Drawing Sheets

CONVERTIBLE BRIEFCASE/TABLE

BACKGROUND OF THE INVENTION

1. Field of the Invention

The present invention relates to combination briefcases and work tables and more particularly pertains to a new convertible briefcase/table for providing a user carrying a briefcase with a convenient work table where none may be readily available.

2. Description of the Prior Art

The use of combination briefcases and work tables is known in the prior art. More specifically, combination briefcases and work tables heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,856,627; U.S. Pat. No. 6,068,355; U.S. Pat. No. 4,790,416; U.S. Pat. No. 5,242,218; U.S. Pat. No. 4,244,632; and U.S. Pat. No. Des. 394,954.

While these devices fulfill their respective, particular objectives and requirements, the aforementioned patents do not disclose a new convertible briefcase/table. The prior art includes briefcases which are convertible into work tables.

SUMMARY OF THE INVENTION

The general purpose of the present invention, which will be described subsequently in greater detail, is to provide a new convertible briefcase/table which has many of the advantages of the combination briefcases and work tables mentioned heretofore and many novel features that result in a new convertible briefcase/table which is not anticipated, rendered obvious, suggested, or even implied by any of the prior art combination briefcases and work tables, either alone or in any combination thereof. The present invention includes a case assembly having a base member, and also having a cover member being hingedly attached to the base member; and also includes a tabletop being hingedly attached to the case assembly; and further includes a tabletop support assembly including brackets being attached to the tabletop and also including support legs being hingedly attached to the brackets; and also includes a fastening assembly for fastening the tabletop to the cover member; and further includes a case support assembly being attached to the case assembly for standing the case assembly upon a surface. None of the prior art includes the combination of elements of the present invention.

There has thus been outlined, rather broadly, the more important features of the convertible briefcase/table in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new convertible briefcase/table which has many of the advantages of the combination briefcases and work tables mentioned heretofore and many novel features that result in a new convertible briefcase/table which is not anticipated, rendered obvious, suggested, or even implied by any of the prior art combination briefcases and work tables, either alone or in any combination thereof.

Still another object of the present invention is to provide a new convertible briefcase/table for providing a user carrying a briefcase with a convenient work table where none may be readily available.

Still yet another object of the present invention is to provide a new convertible briefcase/table that is easy and convenient to set up and use when needed.

Even still another object of the present invention is to provide a new convertible briefcase/table that allows a user to have a table upon which the user may work when none is available such as in airports.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
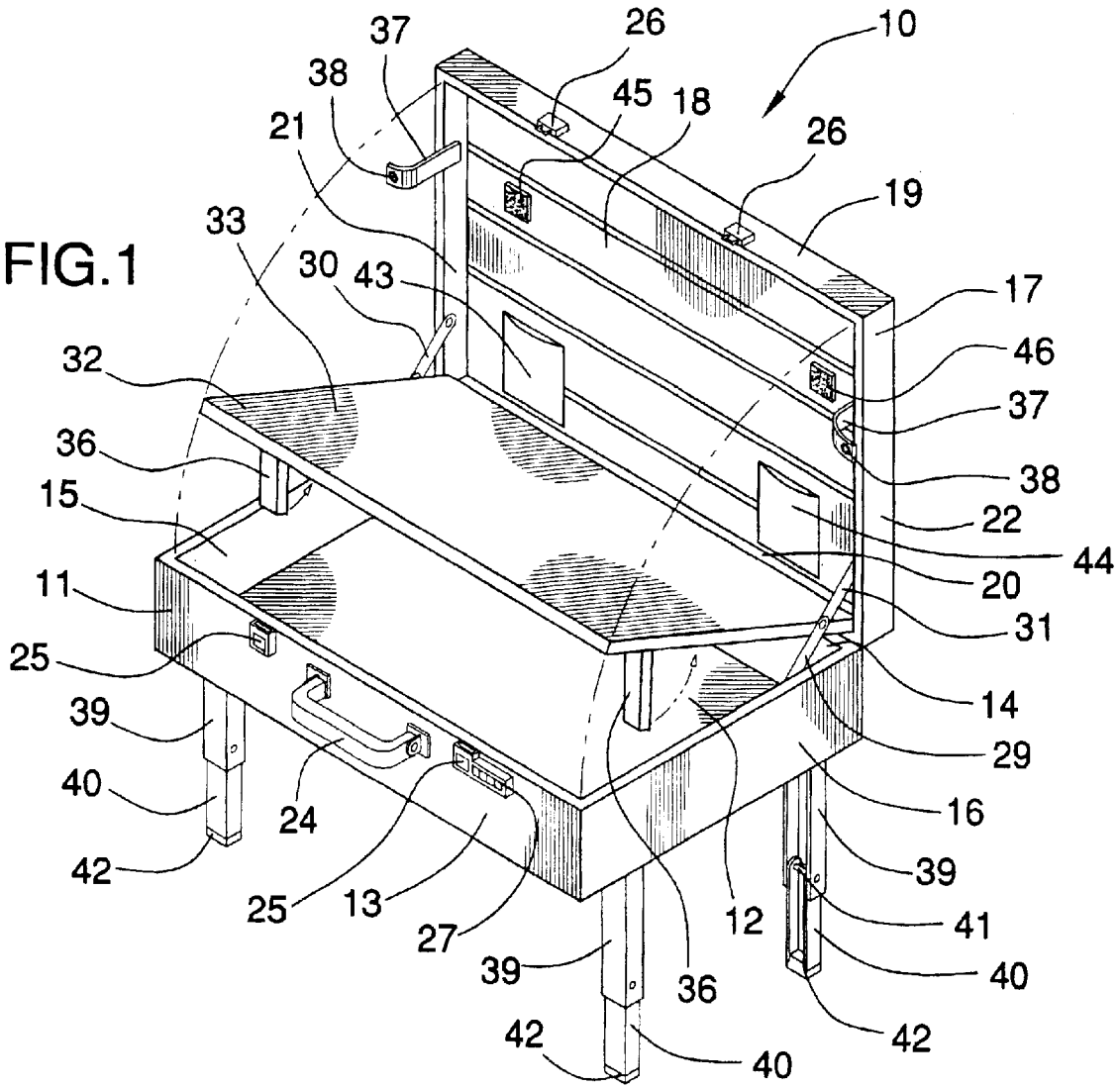
FIG. 1 is a perspective view of a new convertible briefcase/table according to the present invention.
Figure 2:
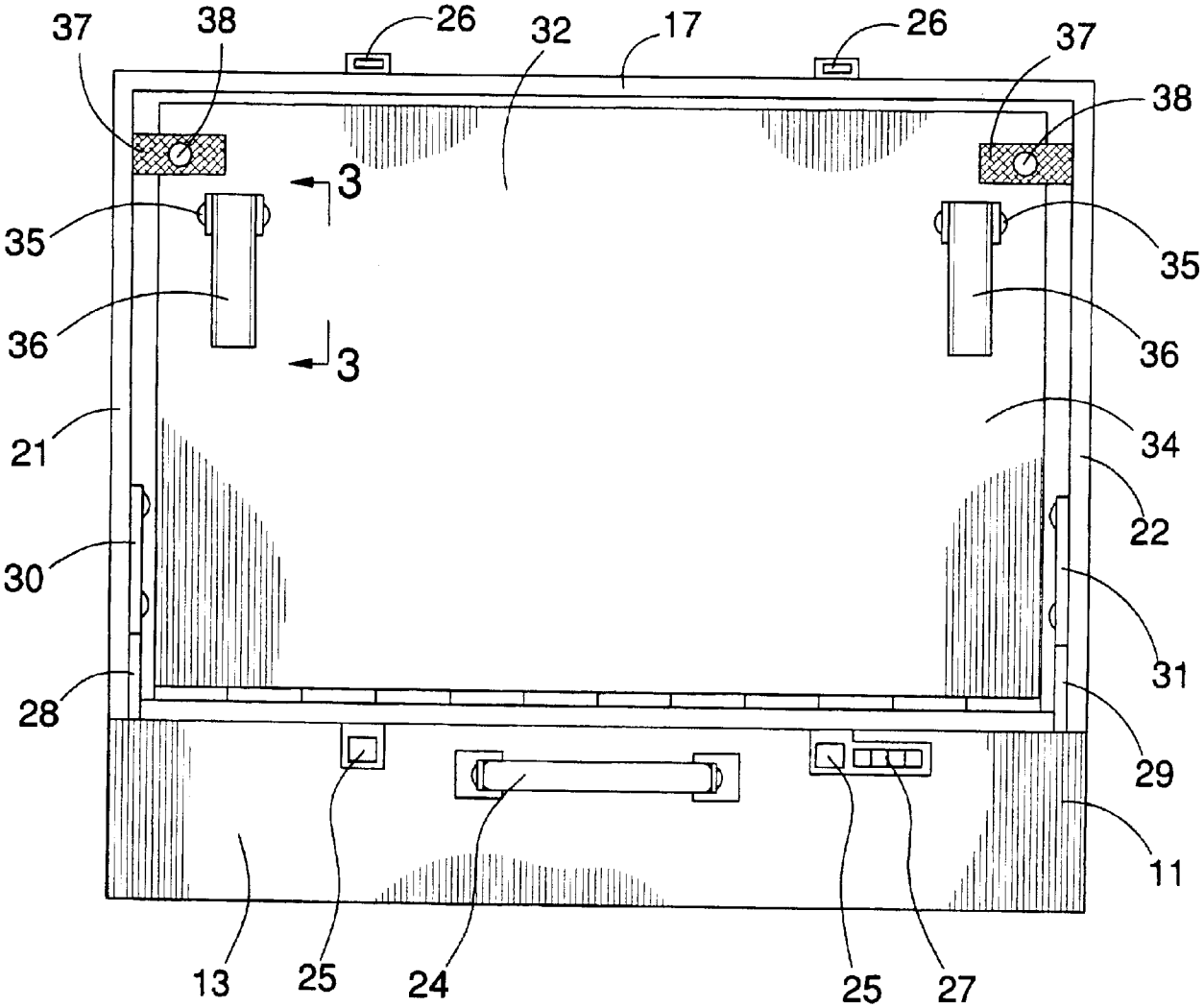
FIG. 2 is a front elevational view of the present invention.
Figure 3:
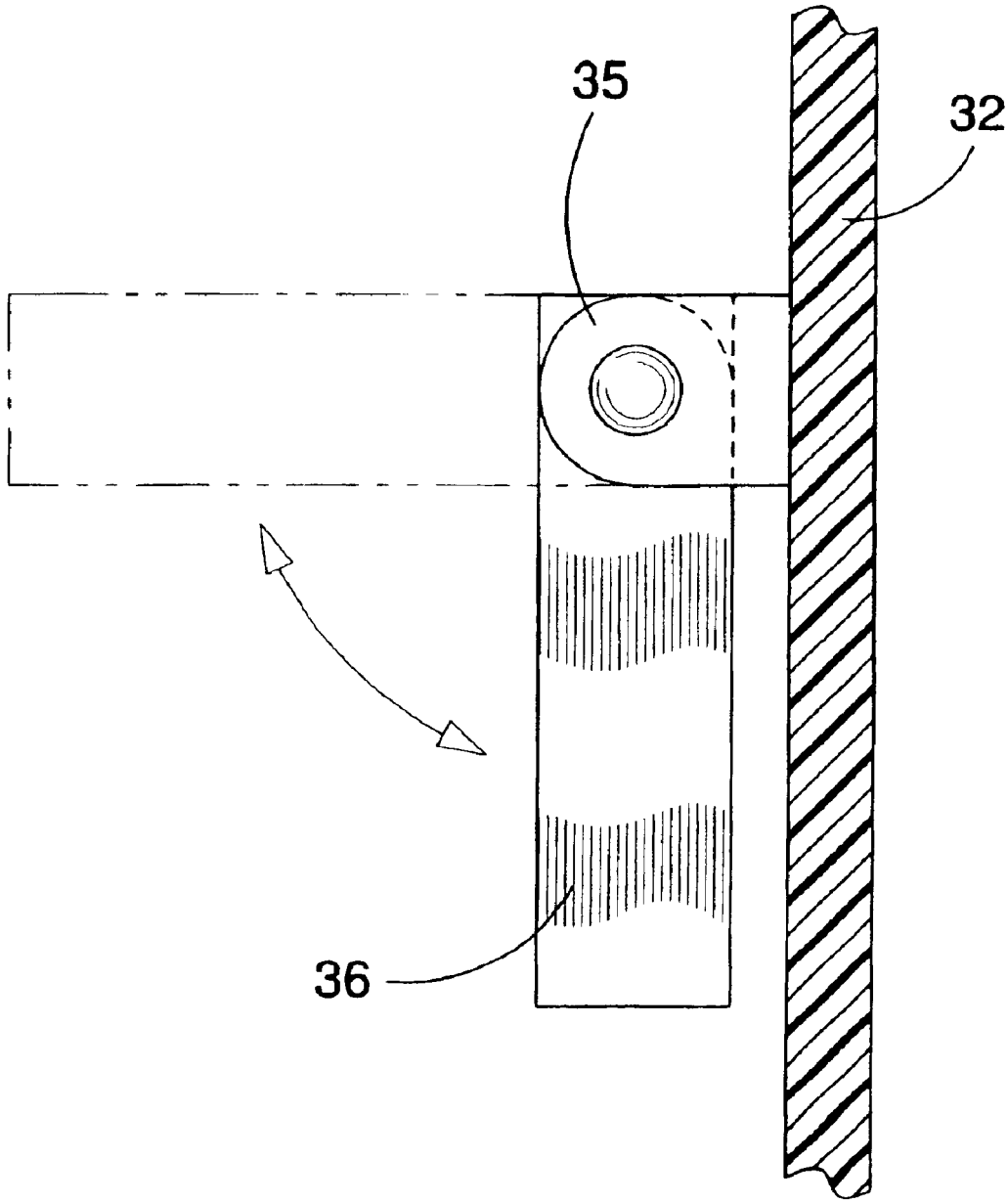
FIG. 3 is a detailed side elevational view of one of the table support members of the present invention.
Figure 4:
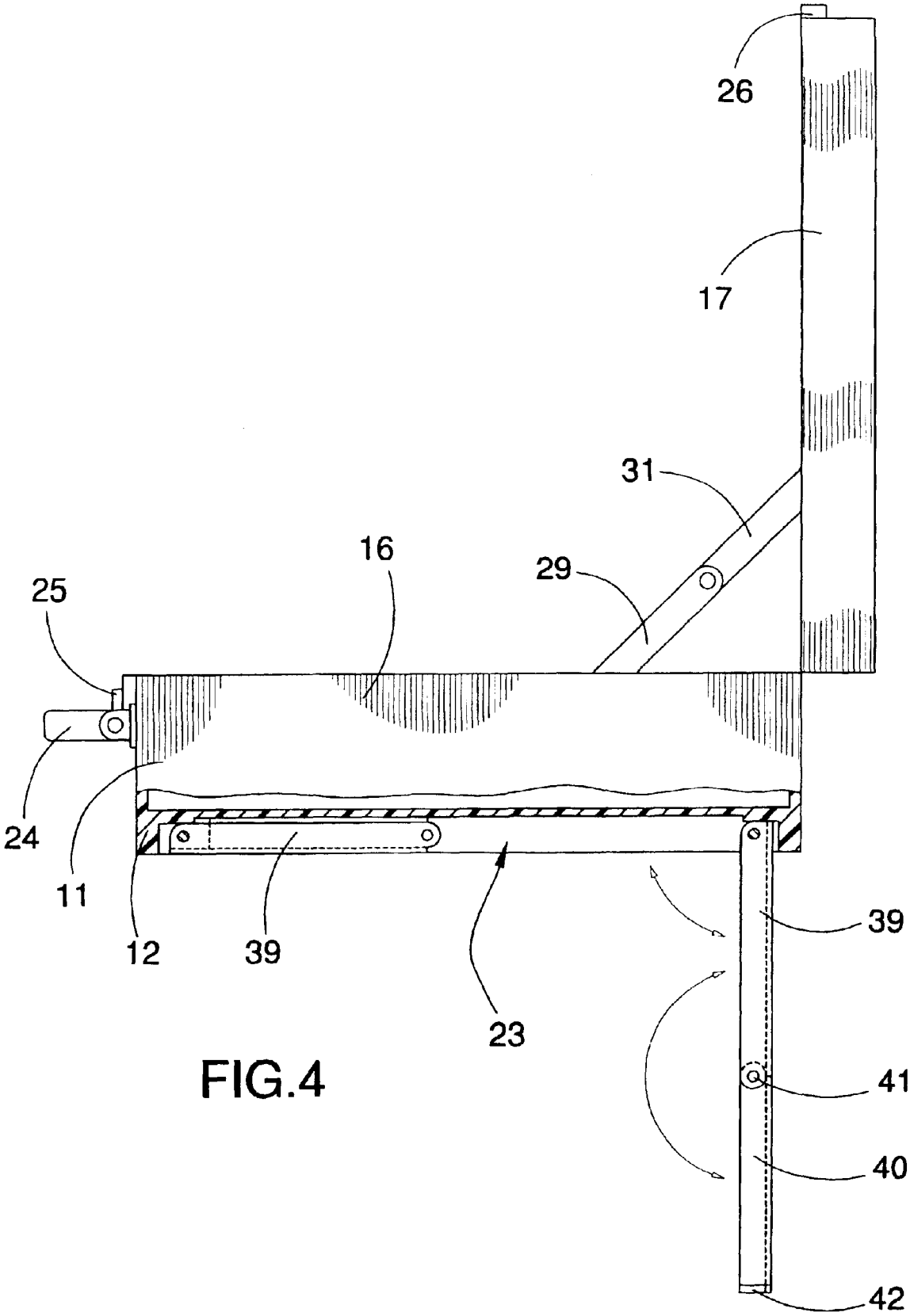
FIG. 4 is a side elevational view of the present invention.

With reference now to the drawings, and in particular to FIGS. 1 through 4 thereof, a new convertible briefcase/table embodying the principles and concepts of the present invention and generally designated by the reference numeral 10 will be described.

As best illustrated in FIGS. 1 through 4, the convertible briefcase/table 10 generally comprises a case assembly having a base member 11, and also having a cover member 17 being hingedly attached to the base member 11. The base member 11 includes a bottom, side, front, and back walls 12–16, and also includes an open top and a storage compartment. The cover member 17 includes top, side, front and back walls 18–22, and also includes an open bottom and a storage compartment with the back wall 20 of the cover member 17 being hingedly attached to the back wall 14 of the base member 11. The case assembly further includes pockets 43,44 being conventionally attached to an underside of the top wall 18, and also includes strap-fastening members 45,46 also being conventionally attached to the underside of the top wall 18.

The bottom wall 12 of the base member 11 has a recessed area 23 being disposed in an outer side thereof. The case assembly further includes a handle 24 being conventionally attached to an outer side of the front wall 13 of the base member 11, and also includes catches 25 being conventionally attached to the outer side of the front wall 13 of the base member 11, and further includes tongue-shaped latches 26 being conventionally attached to an outer side of the front wall 19 of the cover member 17 and being engagable to the catches 25, and also includes a locking mechanism 27 being conventionally attached to the outer side of the front wall 13 of the base member 11 for locking at least one of the tongueshaped latches 26 to at least one of the catches 25, and further includes cover support members 28–31 being conventionally attached to the base member 11 and the cover member 17. The cover support members 28–31 include two pairs of linkages each having a first linkage 28,29 being hingedly and conventionally attached to a respective one of the side walls 15,16 of the base member 11 and also having a second linkage 30,31 being hingedly and conventionally attached to a respective one of the side walls 21,22 of the cover member 17 and being hingedly and conventionally attached to the first linkage 28,29.

A tabletop 32 is hingedly and conventionally attached to the case assembly. The tabletop 32 has a top side 33 and a bottom side 34 and is hingedly received in the storage compartment of the cover member 17. A tabletop support assembly includes brackets 35 being conventionally attached to the tabletop 32 and also includes support legs 36 being hingedly and conventionally attached to the brackets 35 for resting upon the bottom wall 12 of the base member 11. The brackets 35 are generally U-shaped and are securely and conventionally attached to the bottom side 34 and near corners of the tabletop 32. A fastening assembly for fastening the tabletop 32 to the cover member 17 includes straps 37 having first ends which are conventionally attached to the side walls 20,21 of the cover member 17, and also includes fasteners 38 being conventionally attached to second ends of the straps 37 and to the bottom side 34 of the tabletop 32 and being fastenable to one another.

A case support assembly is conventionally attached to the case assembly for standing the case assembly upon a surface. The case support assembly includes a plurality of elongate primary leg members 39 having first ends which are hingedly and conventionally attached in the recessed area 23 of the bottom wall 12 of the base member 11, and also includes elongate secondary leg members 40 having first ends which are hingedly and conventionally attached to second ends of the elongate primary leg members 39, and further includes pins 41 being conventionally attached to the elongate primary leg members 39 and to the elongate secondary leg members 40, and also includes foot members 42 being conventionally attached to second ends of the elongate secondary leg members 40. Each of the elongate primary leg members 39 is generally an elongate channel having a U-shaped lateral cross-section. Each of the elongate secondary leg members 40 is generally an elongate channel having a U-shaped lateral cross-section and being removably disposed in the elongate channel of a respective the elongate primary leg member 39.

In use, the user would swing the elongate primary leg members 39 outwardly from the bottom wall 12 of the base member 11, and would extend the elongate secondary leg members 40 to stand up the case assembly upon a suitable surface The user would then unlatch the cover member 17 from the base member 11 and would lift up the cover member 17 in an upright position. The user would then extend the support legs 36 outwardly from the tabletop 32 and would unfasten the straps 37 from the tabletop 32 to rest the support legs 36 upon the bottom wall 12 of the base member 11 to allow the user to perform all types of work upon the top side 33 of the tabletop 32. When finished, the user would reverse the process by fastening the tabletop 32 to the cover member 17, and closing the cover member 17 upon the base member 11, and pivoting the elongate primary and secondary leg members 39,40 into the recessed area 23 of the bottom wall 12 of the base member 11.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the convertible briefcase/table. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A convertible briefcase/table comprising:

a case assembly having a base member, and also having a cover member being hingedly attached to said base member, said base member includes a bottom, side, front, and back walls, and also includes an open top and a storage compartment, said cover member including top, side, front and back walls, and also including an open bottom and a storage compartment, said back wall of said cover member being hingedly attached to said back wall of said base member, said case assembly further including pockets being attached to an underside of said top wall, and also including strap-fastening members also being attached to said underside of said top wall, said bottom wall of said base member having a recessed area disposed in an outer side thereof;

a tabletop being hingedly attached to said case assembly;

a tabletop support assembly including brackets being attached to said tabletop and also including support legs being hingedly attached to said brackets for resting upon said base member;

a fastening assembly for fastening said tabletop to said cover member; and a case support assembly being attached to said case assembly for standing said case assembly upon a surface, said case support assembly including a plurality of elongate primary leg members having first ends which are hingedly attached in said recessed area of said bottom wall of said base member, and also including elongate secondary leg members having first ends which are hingedly attached to second ends of said elongate primary leg members, and further including pins being attached to said elongate primary leg members and to said elongate secondary leg members, and also including foot members being attached to second ends of said elongate secondary leg members.

2. A convertible briefcase/table as described in claim 1, wherein each of said elongate primary leg members is generally an elongate channel having a U-shaped lateral cross-section.

3. A convertible briefcase/table as described in claim 2, wherein each of said elongate secondary leg members is generally an elongate channel having a U-shaped lateral cross-section and being removably disposed in said elongate channel of a respective said elongate primary leg member.

* * * * *